United States Patent [19]

Childers

[11] Patent Number: 4,541,223

[45] Date of Patent: Sep. 17, 1985

[54] ANTI-JAM SYSTEM FOR A PACKAGING MACHINE

[76] Inventor: Kelly R. Childers, Rte. 3 Box 464, Somerset, Ky. 42501

[21] Appl. No.: 564,071

[22] Filed: Dec. 20, 1983

[51] Int. Cl.[4] ..... B41F 17/00

[52] U.S. Cl. ..... 53/411; 53/65; 53/69; 53/77; 53/131

[58] Field of Search ..... 53/52, 67, 69, 75, 65, 53/77, 507, 508, 506, 505, 411, 131; 101/4, 35

[56] References Cited

U.S. PATENT DOCUMENTS

| | | | |
|---|---|---|---|
| 1,682,464 | 8/1928 | Arelt et al. | 53/65 X |
| 2,908,219 | 10/1959 | Clauss | 53/65 X |
| 3,490,196 | 1/1970 | Sorensen | 53/65 X |
| 3,509,680 | 5/1970 | Weber | 53/131 X |
| 3,577,701 | 5/1971 | Bott et al. | 53/131 |
| 3,741,081 | 6/1973 | Lutz | 53/65 X |

*Primary Examiner*—James F. Coan

*Attorney, Agent, or Firm*—King, Liles & Schickli

[57] ABSTRACT

A method and apparatus for preventing jams in a carton coding machine or the like are disclosed. The apparatus includes a pivotally mounted coding assembly actuated by a cylinder and cooperating solenoid operated directional control valve. A photo transceiver and reflector are provided for detecting a change in article flow, such as is caused by a defective article or article jam. Control means, responsive to a detected defective article or article jam, substantially simultaneously interrupts power to the coding assembly and displaces the coding assembly from the path of the articles. This prevents the defective article from wedging in the coding assembly and jamming the machine. After a delay period, the coding assembly is returned to the operative position for coding the following articles. In addition to the steps of detecting a defective article or article jam, displacing the branding assembly and returning the branding assembly to the operative position, the method includes the step of preventing the displacing step for a predetermined, adjustable length of time to allow properly formed or acceptable cartons to pass.

15 Claims, 5 Drawing Figures

ANTI-JAM SYSTEM FOR A PACKAGING MACHINE

TECHNICAL FIELD

The present invention relates generally to the coding of packages or the like and, more particularly, to a method and apparatus for displacing a coding or branding assembly from an operative coding position in response to a detected defective package or package jam in order to avoid the shut-down of the packaging machine.

BACKGROUND ART

Coding or branding machines for applying an imprint at a predetermined location upon a package or other article traveling along a conveyor are well known in the art. Such machines must provide reliable operation at high speeds in order to keep up with state-of-the-art packaging machines that are capable of delivering as many as 250 cartons, cans or other articles per minute. Additionally, these machines must provide these high operational speeds without damaging the packages, as such damage can lead to machine jamming and spillage of the contents of the packages over the machine. With either of these occurances costly machine service is required and the resultant down time reduces overall productivity.

In an attempt to meet the above demands, U.S. Pat. No. 3,659,521 to Lany discloses an apparatus for marking articles on a moving conveyor. This prior art apparatus includes optical detectors for detecting an article and a pivotally mounted marker that is moved into an operative marking position upon the detection of an article. As should be appreciated, however, this apparatus is inefficient as valuable packaging time is essentially wasted during the period when the marker is moved into the operative marking position following article detection. Further, since the marker is not normally held in the operative position, the marker does not register with the articles in exactly the same relation each time, thereby tending to cause blurred or otherwise unsatisfactory imprinting.

In an effort to overcome these shortcomings, U.S. Pat. No. 4,047,479 to McKay et al discloses an article coding machine wherein the coding assembly or marker is normally held in operative engagement with the articles. This increases machine efficiency and speed of operation while improving imprint quality by insuring a proper, consistent register with the articles. The machine is also provided with a cylinder and cooperating piston for pivoting the coding assembly from the operative position away from the articles being imprinted so as to allow improved access for maintenance.

The McKay machine, however, is not without its disadvantages. It is not provided with any means for detecting, for example, a defective carton upstream of the coding assembly along the conveyor. Therefore, a defective carton can enter and wedge in the branding assemby thereby jamming the machine and requiring costly down time and manual labor to release and/or repair.

Thus, a need is identified for an anti-jam system capable of detecting a defective package or other article and displacing the coding assembly from the package path so as to allow the defective package to pass and prevent a shut-down of the machine. The system then returns the coding assembly to the operative position in proper registration along the conveyor path for properly imprinting the following packages.

DISCLOSURE OF THE INVENTION

Accordingly, it is a primary object of the present invention to provide an anti-jam system for an imprinting or coding machine overcoming the above-described limitations and disadvantages of the prior art.

Another object of the present invention is to provide a method and apparatus for preventing jams in an imprinting or coding machine.

Still another object is to provide an anti-jam system for an imprinting or coding machine capable of detecting a defective package, carton or other article.

A further object of the present invention is to provide an anti-jam system and method for displacing the coding assembly from the path of a detected defective package or carton so as to allow that package or carton to pass and prevent the machine from jamming.

A still further object of the present invention is to provide an anti-jam system and method for allowing a defective carton to pass without imprinting and returning the coding assembly to an operative position in proper registration for imprinting the following cartons.

Additional objects, advantages and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention a preferred embodiment is described herein in the form of an improved apparatus and method for coding cartons including a system for preventing jams along the carton path.

The anti-jam system includes a means for mounting the coding assembly for pivotal movement between a first position in operative marking engagement with the cartons moving along a conveyor, and a second position out of the path of the cartons. Means for detecting and signaling a change in the flow of cartons, such as a defective carton or carton jam, upstream of the coding assembly along the conveyor is provided to initiate the movement of the coding assembly. The detecting means may include a photo transceiver and cooperating reflector at opposite sides of the conveyor. For example, the transceiver reflector combination is positioned so that an open carton or an improperly closed carton on the conveyor breaks the light beam for more than the normal time period. Control means responsive to the abnormal signal then interrupts the coding assembly operation by moving the assembly to the second position out of the carton path. The assembly is held out of the path for a predetermined length of time sufficient only to allow the defective carton to pass and prevent the carton from jamming in the coding assembly and forcing a shut-down of the machine. The assembly is then returned to the first, operative position in proper registration for imprinting or coding the following cartons.

The retention of the coding assembly in operative position and proper registration during normal operation insures that each carton is satisfactorily imprinted at the desired location. Also, as another advantage of the assembly being normally in the operative position and in position for engagement with the cartons, high speed operation is assured and no production time is wasted as in arrangements wherein the marker or coding assembly is moved into imprinting position only upon detection of a carton.

Preferably, the control means operates on the principle that a carton taking more than a normal, predetermined time to pass the transceiver indicates a condition for interruption of the coding process. Thus, an improperly closed carton, such as with one gable open and forming a spout (spouted carton) or an open carton forming a jam against the coding assembly safely interrupts the coding operation allowing the defective carton to pass for removal downstream by the operator.

In order to fine tune the control means and adjust for different size cartons, timing means is provided. The set period of time in response to the adjustment corresponds with the length of time necessary for the particular carton on the conveyor to move past the transceiver and reflector. Thus, when a carton moves past the transceiver and breaks the light beam under normal conditions, no power interruption or displacement of the coding assembly takes place. If, however, article flow is altered, such as by a defectively formed or sealed carton or by a line of cartons jammed together on the conveyor breaking the beam for a longer period of time than normal, interruption by displacement of the coding assembly takes place. The adjustment provided also allows the operator to fine tune the anti-jam system sensitivity to a variety of operating conditions and conveyor delivery speeds.

In the preferred embodiment, the anti-jam system includes a solenoid switch, for interrupting and restoring power to the coding assembly operation. A cylinder and cooperating solenoid operated control valve are also responsive to the control means and serve to actually displace the coding assembly between the first and second positions described above.

The control means further includes circuit means for substantially simultaneously activating the solenoid switch to interrupt power to the coding assembly and activating the solenoid control valve and cylinder to displace the coding assembly to the second position away from the carton path. This assures that the coding rollers in the coding assembly are separated as the assembly is displaced. Thus, undesired article pick-up is prevented and the possibility of contaminating the work environment through lifting of a carton from the conveyor and subsequent dropping and damaging of the carton is minimized.

The circuit means further includes a built-in delay during which time the coding assembly is retained in the second position out of the path of the cartons so that the defective carton or article jam may pass the coding assembly. Of course, any non-defective cartons that move past the coding assembly during this time may be collected downstream for return to the conveyor upstream of the coding assembly. Also, means are provided for adjusting the duration of this delay so that the operator may fine tune the anti-jam system to meet the particular needs.

The circuit means cf the anti-jam system also substantially simultaneously reactivates the switch means or solenoid to restore power to the coding assembly and reactivates the control valve and cylinder to return the coding assembly to the operative position for properly coding the following cartons. Therefore, there is no excess operational delay time as normal imprinting operation of the coding assembly is immediately resumed as soon as the assembly properly registers in its first position.

In a further aspect of the invention, in accordance with its objects and purposes, the method for preventing jams in a carton imprinting machine includes the steps of detecting the improperly formed carton and displacing and returning the coding assembly. The initial step involves detecting a defective carton or article jam along the conveyor upstream of the coding assembly. Then, in response to a detected defective carton, the coding assembly is displaced from a first operative position in marking engagement with the cartons to a second position out of the path of the cartons. This allows the defective carton to pass the coding assembly and prevents it from becoming wedged therein, thereby jamming the machine and forcing a costly shutdown. Following the passage of the defective carton, the coding assembly is returned to the first, operative position in proper registration for coding the following cartons.

By normally positioning the coding assembly in operative engagement with the cartons, greater efficiency, operating speed and productivity are achieved. This is because the assembly is only moved when a defective carton is detected. Advantageously, this requires less time than would be necessary in an imprinting machine that moves the coding assembly into engagement to imprint each detected carton. Also, since the coding assembly is normally in the operative position in engagement with the cartons, clear, consistent imprinting is assured at the desired location on the carton. This is not true of an imprinting apparatus wherein the coding assembly or marker is moved to engage the carton. In such a situation, the movement of both the carton and the coding assembly commonly leads to a blurred, unsatisfactory imprint. Additionally, the dual movement of the carton and coding assembly creates a greater chance of error in properly locating the imprint on the carton.

Preferably, the method includes the additional step of preventing the displacing step for a predetermined, adjustable length of time. The system allows adjustment of the anti-jam system to a variety of operating conditions and conveyor delivery speeds. The length of time is adjusted to correspond to the time necessary for a properly shaped article to move past the detector. If the detector senses an article for a longer period of time, such as would occur with, for example, a defectively sealed or spouted carton or a line of cartons jammed together on the conveyor, the displacing step then occurs.

The method may also include the additional steps of proceeding with the returning step after a delay to allow the defective carton to pass the coding assembly and substantially simultaneously interrupting and displacing the coding assembly to a position out of the carton path. As previously indicated, this assures that the coding assembly is not operational during displacement and further, prevents the removal of cartons from the conveyor that may result in damaged cartons and spillage leading to the need for machine maintenance.

Still other objects of the present invention will become readily apparent to those skilled in this art from the following description wherein there is shown and described a preferred embodiment of this invention, simply by way of illustration of one of the modes best suited to carry out the invention. As it will be realized, the invention is capable of other different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention, and together with the description serves to explain the principles of the invention. In the drawing.

Reference will now be made in detail to the present preferred embodiment of the invention, an example of which is illustrated in the accompanying drawing.

BEST MODE OF CARRYING OUT THE INVENTION

Figure 1:
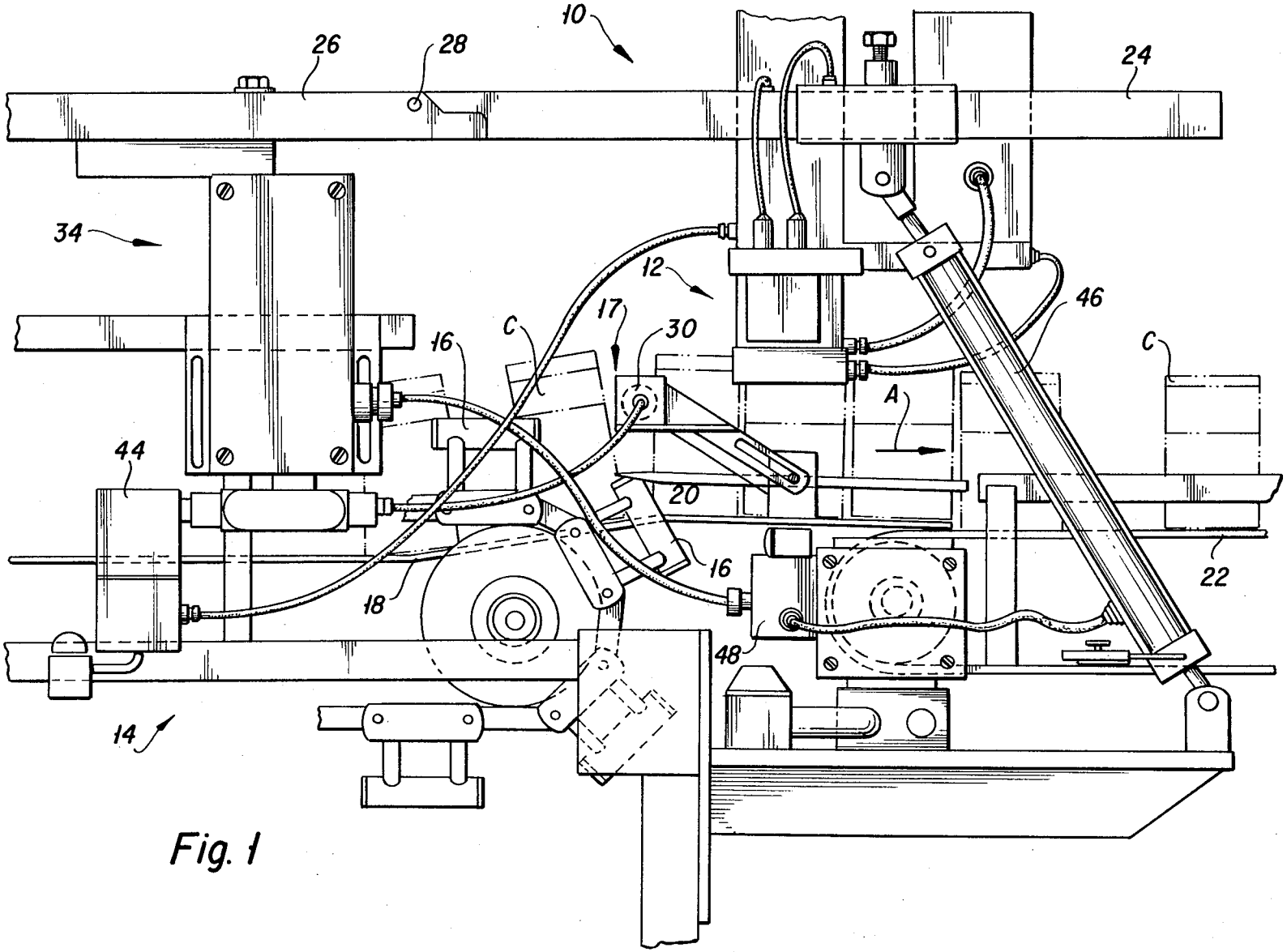
FIG. 1 is a side elevational view of the anti-jam system of the present invention for use on a carton imprinting machine, such as the one shown, wherein the coding assembly is in a first, operative position for marking the cartons.

Reference is now made to FIG. 1 showing the anti-jam system 10 of the present invention for displacing a coding assembly 12 from an operative marking position in response to a detected change in carton flow as, for example, may be caused by a defective carton or carton jam. The displacement of the coding assembly out of the path of the cartons allows the passage of the defective carton or carton jam and prevents the costly and time consuming shut-down of the machine.

As shown in FIG. 1, the anti-jam system 10 includes a conveyor 14 having side lugs 16 for moving the cartons C at spaced intervals 17 up delivery ramp 18 to downwardly inclined feeding transfer ramp 20. It should be appreciated that any number of rows for delivering cartons may be provided along the conveyor 14 so long as the intervals or gaps 17 between the cartons remain in alignment across the conveyor.

The cartons C on the transfer ramp 20 are in abutting relation and are pushed forward through the coding assembly 12 for coding by the delivery of more cartons from conveyor 14. Following coding, the cartons C advance to a second conveyor 22 that transports the cartons away for further processing or packaging.

The coding assembly 12 is normally retained in a first position (see FIG. 1) in operative marking engagement with the upwardly extending sealed end of the cartons C as they advance down the ramp 20 in the direction of arrow A. Therefore, no time is expended in moving the coding assembly 12 into marking engagement with each carton and imprinting efficiency and speed of operation are maximized. Further, since the coding assembly 12 remains stationary throughout the imprinting process, blurring is avoided and a properly located imprint of improved clarity is provided.

Figure 2:
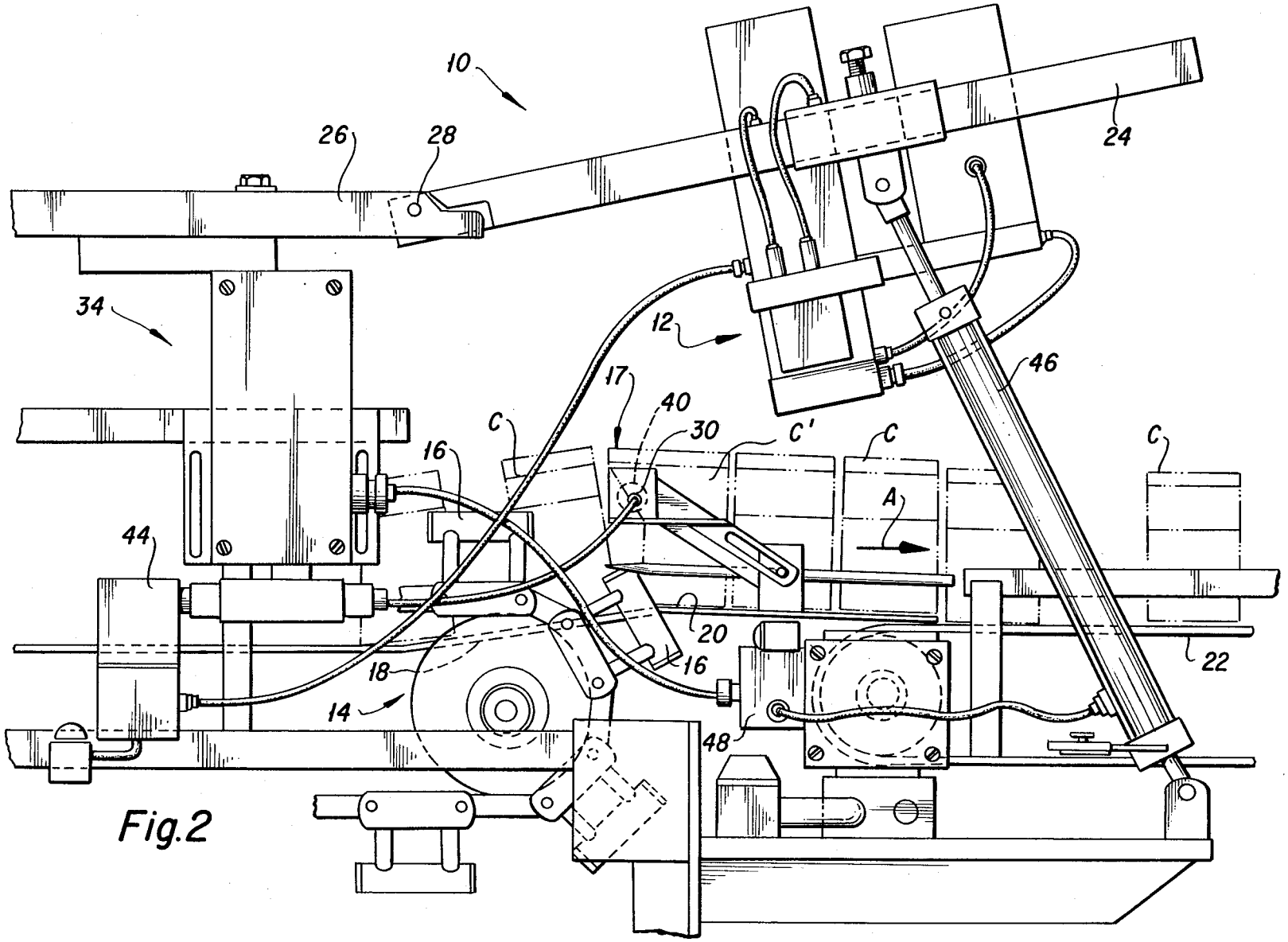
FIG. 2 is a side elevational view of the present invention showing the coding assembly pivoted into a second position out of the path of the cartons so as to allow the passage of the detected defective carton.

As seen from viewing FIGS. 1 and 2, the coding assembly 12 is connected to and supported by overhead frame member 24. Frame member 24 is pivotally connected to base frame member 26 by means of pin 28 so as to form a hinge. This arrangement allows movement of the assembly 12 between a first operative position (shown in FIG. 1) and a second position out of the path of the cartons C (shown in FIG. 2).

Figure 4:
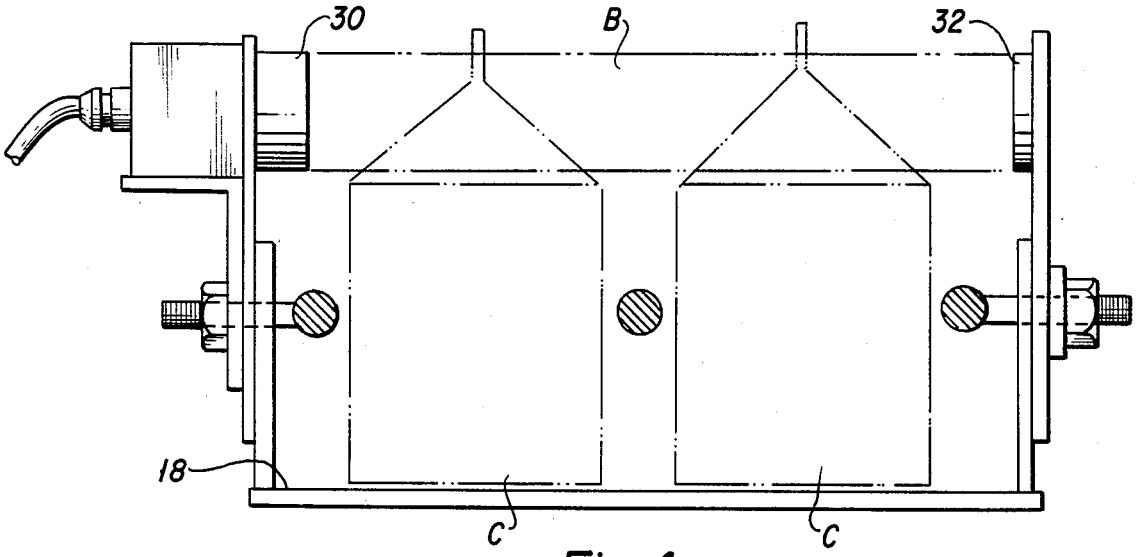
FIG. 4 is a cross-sectional view transverse to the path of the cartons showing the photo transceiver and reflector for detecting a defective carton or carton jam along the conveyor.

The anti-jam system 10 includes means for detecting and signaling a change in carton flow such as a photo transceiver 30 and cooperating reflector 32. As shown in FIG. 4, the photo transceiver 30 and reflector 32 are positioned on opposite sides of the delivery ramp 18 of the conveyor 14 and in line with the upper, sealed gable portion of the cartons C. In the embodiment shown, the photo transceiver 30 and reflector 32 are positioned directly at the top of ramp 18 just upstream of the coding assembly 12. The inclination of the ramp 18 advantageously serves to tip the cartons C to create increased sized gaps 17 between the cartons. This is an important feature for improving the performance and integrity of the anti-jam system 10 as may be appreciated from the further description below.

Figure 3:
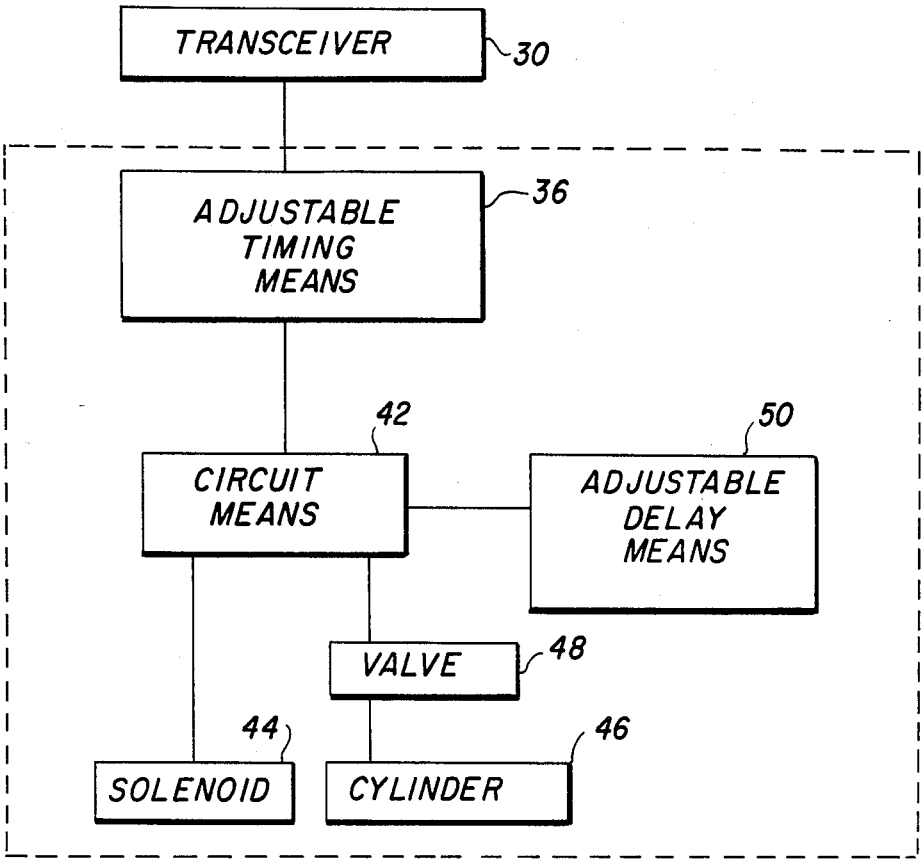
FIG. 3 is a schematic diagram of the circuit of the present invention.

The transceiver 30 is connected to a control means 34 including adjustable timing means 36 (see FIG. 3). The timing means 36 prevents power interruption and displacement of the coding assembly 12 for a predetermined length of time. This length of time is adjusted to correspond to the length of time necessary for a carton C under normal conveyor flow to move past the transceiver 30 and reflecter 32. Thus, when a carton C moves past the transceiver 30 and breaks the light beam under normal operating conditions, no power interruption or displacement of the coding assembly 12 occurs. If, however, carton flow changes so that the light beam of the transceiver 30 is broken for a longer period of time than normal, power interruption and displacement of the coding assembly 12 occurs.

Figure 5:
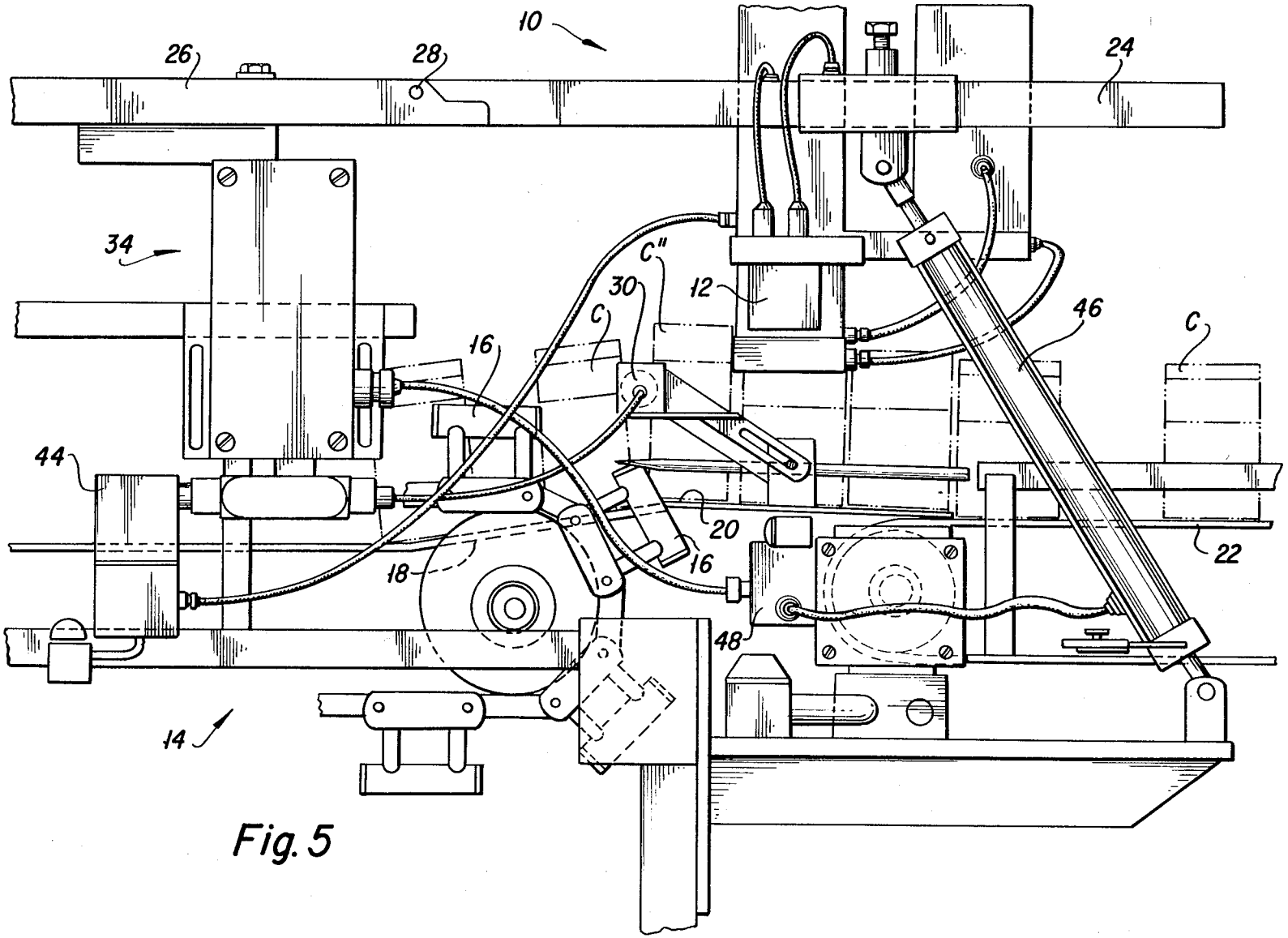
FIG. 5 is a side elevational view of the anti-jam system of the present invention showing an unsealed carton upstream of the coding assembly.

The change in flow, may, for example, be caused by the extended spout 40 of a spouted carton C′ (see FIG. 2) extending across the gap 17 to maintain the light beam in the broken state or by a line of cartons jammed together across the path of the light beam. The latter occurs, for example, when an unsealed carton C″ (see FIG. 5) contacts the coding assembly 12 but is too tall to pass through. The cartons C behind the unsealed carton C″ back up behind this carton until they are in the path of the beam and the assembly 12 is raised to allow the jam to pass. Of course, it should be recognized that any properly sealed carton that moves past the coding assembly 12 when it is in this raised position may be collected for return to the conveyor 14 upstream of the assembly and proper marking.

When a spouted carton C′ or carton jam is detected as indicated above, a signal is sent from the adjustable timing means 36 to circuit means 42 of control means 34. The circuit means 42 then substantially simultaneously interrupts power to the coding assembly 12 by means of a switch, such as a solenoid switch 44, and displaces or pivots the assembly by means of a cylinder 46 and cooperating directional control valve 48 to a second, raised position (see FIG. 2) out of the path of the cartons C. The interruption of power opens the coding rollers and serves to eliminate carton pick-up by the coding assembly 12, thereby preventing the removal of cartons from the ramp 20 and the possibility of dropping or damaging the cartons and spilling the contents over the machine.

The circuit means 42 includes a built-in delay means 50 for retaining the assembly 12 in the second position out of the path of the cartons C for a length of time sufficient to allow the passage of the defective carton C′ or carton C″ in a jam before returning the assembly to the operative position (see FIG. 1) for properly marking the following cartons.

The circuit means 42 also substantially simultaneously reactivates the solenoid 44 to restore power to the assembly 12 and the cylinder 46 through cooperating directional control valve 48 to return the assembly to the first operative position for coding the following cartons C. This assures maximum efficiency as normal coding operation may be resumed immediately upon return of the assembly 12 to proper registration over the ramp 20.

The method of the invention includes the step of detecting a change in carton flow as caused by a defective or spouted carton C′ or a carton jam by carton C″. This detection step is performed by the photo transceiver 30 and reflector 32 (see FIGS. 4 and 5).

Following detection, cylinder 46 and solenoid operated directional control valve 48 perform the step of displacing the coding assembly from a first position in operative marking engagement with the cartons (FIG. 1) to a second position out of the path of the cartons (FIG. 2). This allows a detected defective or jammed carton C′, C″ to pass the coding assembly 12 and prevents such cartons from being picked-up, jamming or wedging in the assembly. Therefore, costly machine down-time is avoided and optimal productivity levels are achieved. Furthermore, the labor expense involved in monitoring the operation and manually releasing the jam is avoided.

After the defective carton C′ or jammed carton C″ moves past the assembly 12, the assembly is smoothly and efficiently returned to the first operative position by means of the cylinder 46 and valve 48.

Preferably, the method includes the additional step of preventing displacement for a predetermined, adjustable length of time. This allows properly sealed cartons to pass without interruption. The operator can provide adjustment of the anti-jam system 10 to a variety of carton sizes, operating conditions and conveyor 14 delivery speeds. If desired, the timing means 36 may be automatically adjusted to changes in the speed of the conveyor 14 caused by load variations so as to prevent inadvertent raising of the assembly 12.

The method may also include the step of substantially simultaneously interrupting power to the coding assembly 12 and displacing the coding assembly from the first, operative marking position to the second position out of the path of the cartons. Such a step prevents the pick-up of the cartons C from the ramp 20 as the assembly 12 is displaced. Since continued operation of the assembly 12 under these conditions could lead to dropped or damaged cartons and subsequent spillage, the step serves to reduce the expenses involved in maintaining a clean working environment.

In summary, numerous benefits have been described which result from employing the concepts of the invention. The coding assembly 12 is normally retained in an operative marking position so as to provide improved speed of operation and clear, consistent coding at the proper location on the cartons C. Upon the detection of a defective carton or a carton jam by the photo transceiver 30, the coding assembly 12 is displaced to a second position allowing the passage of the defective carton or jam. Thus, the need for manual monitoring and releasing of a jam in the coding assembly 12 is prevented and the expense and costly down time associated therewith is avoided.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

I claim:

1. An anti-jam system for a packaging machine or similar article handling machine having a conveyor defining a path of movement for the articles, comprising:

a coding assembly mounted for movement between a first position in operative engagement with the articles moving along the conveyor and a second position out of the path of the articles;

means for detecting and signaling a change in the flow of articles along the path; and control means responsive to said signal from said detecting and signaling means, said control means for positioning of said coding assembly and moving said assembly to said second position out of the path of the articles, thereby allowing any defective article to pass and preventing a jam before returning said assembly to said first, operative position for properly coding the articles.

2. The anti-jam system disclosed in claim 1, wherein said detecting and signaling means includes a photo transceiver and reflector at opposite sides of the conveyor.

3. The anti-jam system disclosed in claim 1, wherein said control means includes an adjustable timing means that prevents power interruption and displacement of said coding assembly for a predetermined, adjustable length of time so as to allow passage of acceptable articles.

4. The anti-jam system disclosed in claim 1, wherein said control means includes switch means for interrupting and restoring the coding operation.

5. The anti-jam system disclosed in claim 1, wherein said coding assembly is pivotally mounted for movement above said conveyor.

6. The anti-jam system disclosed in claim 1, wherein said control means includes a cylinder and cooperating directional control valve for displacing said coding assembly between said first and second positions.

7. The anti-jam system disclosed in claim 1, wherein said control means includes switch means for interrupting and restoring the coding operation and a cylinder and cooperating directional control valve for displacing said coding assembly between said first and second positions.

8. The anti-jam system disclosed in claim 7, wherein control means includes circuit means that substantially simultaneously activates said switch means to interrupt power to the coding assembly and activates said directional control valve and cylinder to displace said coding assembly to said second position.

9. The anti-jam system disclosed in claim 8, wherein said circuit means includes a delay means to retain the coding assembly in the second position out of the path of the articles.

10. The anti-jam system disclosed in claim 9, wherein said control means includes a means for adjusting the duration of said delay so as to provide fine tuning of the anti-jam system.

11. The anti-jam system disclosed in claim 9, wherein said circuit means is operative following said delay to substantially simultaneously reactivate said switch means to restore power to said coding assembly and reactivate said directional control valve and cylinder to displace said coding assembly to said first, operative position for properly coding the articles.

12. A method for preventing jams in a article coding machine or the like equipped with a coding assembly and a conveyor for advancing the articles along a path, the method, comprising the steps of:

detecting a change in article flow along the conveyor upstream from the coding assembly;

displacing the coding assembly from a first position in operative marking engagement with the articles moving along the conveyor to a second position out of the path of the articles, thereby allowing any defective articles to pass and preventing a jam of the machine; and returning the coding assembly to the first, operative position for properly coding the cartons.

13. The method disclosed in claim 12, comprising the additional step of preventing the displacing step for a predetermined, adjustable length of time so as to allow the passage of acceptable articles.

14. The method disclosed in claim 12, comprising the additional step of proceeding with the returning step after a predetermined delay so as to allow the defective article to pass the coding assembly and minimize the passage of acceptable articles.

15. The method disclosed in claim 12, comprising the additional step of substantially simultaneously interrupting power to the coding assembly and displacing the coding assembly from said first, operative position to said second position out of the path of said articles.

* * * * *